US011191375B2

(12) United States Patent
Liu

(10) Patent No.: US 11,191,375 B2
(45) Date of Patent: Dec. 7, 2021

(54) PILLOW

(71) Applicant: He Liu, Heilongjiang (CN)

(72) Inventor: He Liu, Heilongjiang (CN)

( * ) Notice: Subject to any disclaimer, the term of this patent is extended or adjusted under 35 U.S.C. 154(b) by 0 days.

(21) Appl. No.: 16/632,864

(22) PCT Filed: Apr. 9, 2019

(86) PCT No.: PCT/CN2019/081926
§ 371 (c)(1),
(2) Date: Jan. 21, 2020

(87) PCT Pub. No.: WO2019/201120
PCT Pub. Date: Oct. 24, 2019

(65) Prior Publication Data

US 2021/0037996 A1 Feb. 11, 2021

(30) Foreign Application Priority Data

Apr. 20, 2018 (CN) ..... 201820567837.8

(51) Int. Cl.
*A47G 9/10* (2006.01)

(52) U.S. Cl.
CPC ..... *A47G 9/1081* (2013.01); *A47G 9/1054* (2013.01)

(58) Field of Classification Search
CPC ..... A47G 9/10; A47G 2009/1018; A47G 9/1081; A47G 9/1054
See application file for complete search history.

(56) References Cited

U.S. PATENT DOCUMENTS 3,243,828 A * 4/1966 McCarty ..... A47G 9/109 5/636
5,168,590 A * 12/1992 O'Sullivan ..... A47G 9/0253 5/421
D376,288 S * 12/1996 Antonian ..... D6/596
5,809,594 A * 9/1998 Isogai ..... A47G 9/10 5/644
D402,150 S * 12/1998 Wurmbrand ..... D6/601
6,513,179 B1 * 2/2003 Pan ..... A47G 9/109 5/636

(Continued)

FOREIGN PATENT DOCUMENTS

CN 202843102 U 4/2013
CN 103844744 A 6/2014
CN 205030928 U 2/2016

(Continued)

*Primary Examiner* — Eric J Kurilla
(74) *Attorney, Agent, or Firm* — Robert L. Stearns; Dickinson Wright, PLLC

(57) ABSTRACT

The present application discloses a pillow, the pillow includes a pillow body; a first raised portion disposed on a first side of the pillow body and having a first raised height so as to support a neck of a human body in a supine position; and a second raised portion disposed on a side of the pillow body and having a second raised height so as to support the neck of the human body in a lateral position; wherein the first height is less than the second height. In the present application, the first side of the pillow body is provided with raised portions with different positions, which can meet the different requirements of heights of the pillow of human body in different sleeping positions, the structure is simple, and is helpful for human head to relax and improve sleep quality.

10 Claims, 6 Drawing Sheets

(56) References Cited

U.S. PATENT DOCUMENTS 6,671,906 B1 * 1/2004 Milligan ..... A47G 9/109
5/636
6,981,288 B1 * 1/2006 Hu ..... A47G 9/10
5/636

FOREIGN PATENT DOCUMENTS

CN 206560234 U 10/2017
JP 2016106908 A 6/2016

* cited by examiner

PILLOW

CROSS REFERENCE TO RELATED APPLICATION

The present application is a 35 U.S.C. § 371 national stage application of PCT Patent Application Ser. No. PCT/CN2019/081926 filed on Apr. 9, 2019, which claims priority to Chinese Patent Application Ser. No. CN201820567837.8, filed on Apr. 20, 2018, the entire disclosures of which are incorporated herein by reference in their entireties.

TECHNICAL FIELD

The present application relates to bedding, and more particularly to a pillow.

BACKGROUND

People sleep about one third of a day, so a comfortable sleeping environment plays a vital role in human body health. At present, pillows are generally rectangular parallelepipeds of the same overall height or provided with a protrusion at one end, and the interior is filled with a flexible substance.

The inventor of the present application has found in long-term research and development that the human body needs pillows of different heights when adopting different sleeping positions, for example, when in a supine position, the height of the neck is lower, and a low pillow is required; when in a lateral position, the height of the neck is greater, and a high pillow is required. However, the ordinary pillows cannot meet the needs of different sleeping positions.

SUMMARY

The present application provides a pillow, in order to solve the technical problem that the ordinary pillows cannot meet the needs of different sleeping positions.

In order to solve the above technical problem, the technical solution adopted in the present application is to provide a pillow, the pillow includes a pillow body; a first raised portion disposed on a first side of the pillow body and having a first raised height so as to support a neck of a human body in a supine position; and a second raised portion disposed on a side of the pillow body and having a second raised height so as to support the neck of the human body in a lateral position; wherein the first height is less than the second height.

The first side of the pillow body is provided with two second raised portions and one first raised portion, and the two second raised portions are respectively disposed at two ends of the first raised portion.

An end of the second raised portion adjacent to the first raised portion is an oblique surface, such that the human body can be slidably moved between the first raised portion and the second raised portion.

A second side of the pillow body is provided with a third raised portion and a fourth raised portion, a height of the second side is greater than that of the first side, a width of the fourth raised portion is greater than that of the second raised portion, the third raised portion has a third raised height so as to support the neck of the human body in a supine position, the fourth raised portion has a fourth raised height so as to support the neck of the human body in a lateral position, and the third height is greater than the first height and less than the fourth height.

A middle portion of the pillow body is provided with a recessed portion configured for accommodating a head of the human body.

The pillow further comprises a first heightening pad, a lower side of the first heightening pad is arranged with a first joint portion, an upper side of the second raised portion is provided with a second joint portion corresponding to the first joint portion, and first joint portion is combined with the second joint portion to fix the first heightening pad on the second raised portion.

A length and a width of the first heightening pad are respectively less than a length and a width of the second raised portion.

An end of the first heightening pad adjacent to the first raised portion is an oblique surface, and is located on a same oblique surface as an end of the second raised portion adjacent to the first raised portion, such that the human body can be slidably moved between the first raised portion and the second raised portion.

The pillow further comprises at least one first clamping pad disposed between the second raised portion and the first heightening pad, and respectively connected with the second raised portion and the first heightening pad.

The pillow further comprises a base pad fixedly disposed at a lower side of the pillow body.

In the present application, the first side of the pillow body is provided with raised portions with different positions, which can meet the different requirements of heights of the pillow of human body in different sleeping positions, the structure is simple, and is helpful for human head to relax and improve sleep quality.

BRIEF DESCRIPTION OF THE DRAWINGS

In order to explain the embodiments of the present application more clearly, a brief introduction regarding the accompanying drawings that need to be used for describing the embodiments of the present application or the prior art is given below; it is obvious that the accompanying drawings described as follows are only some embodiments of the present application, for those skilled in the art, other drawings can also be obtained according to the current drawings on the premise of paying no creative labor.

DESCRIPTION OF THE ENABLING EMBODIMENT

Figure 1:
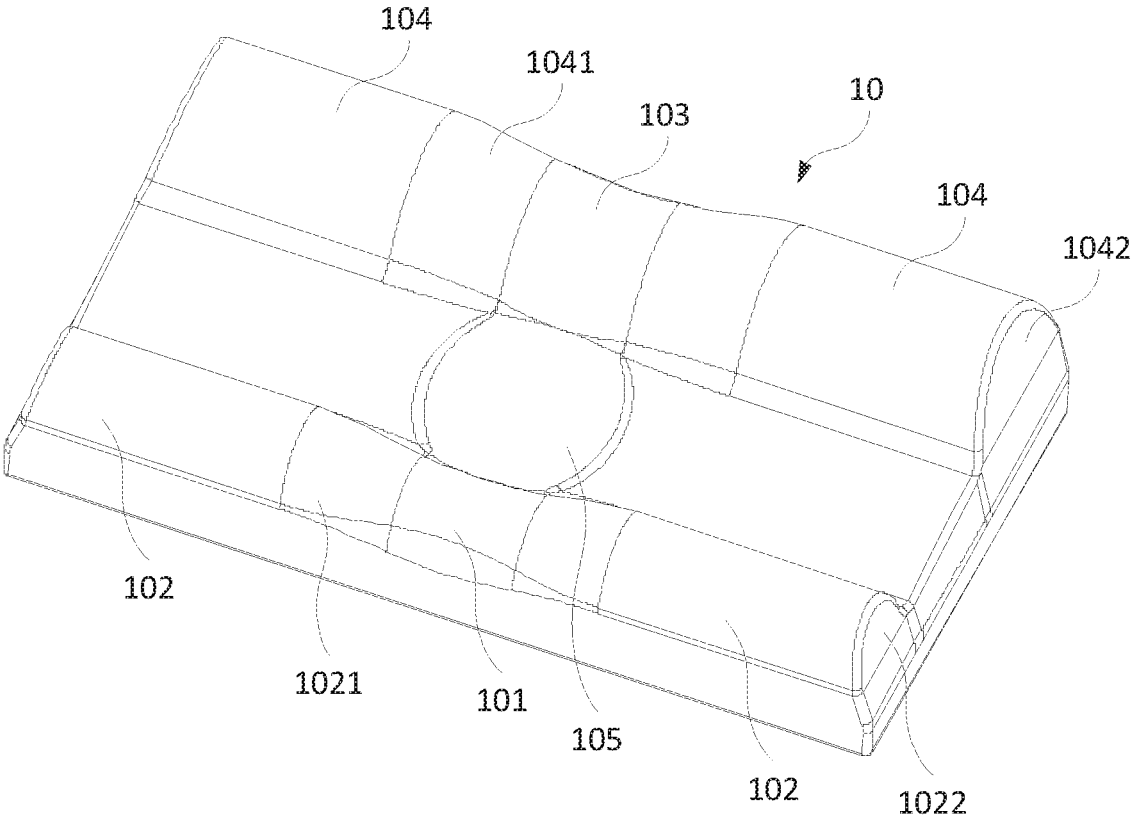
FIG. 1 is a schematic structural view of an embodiment of a pillow of the present application.
Figure 2:
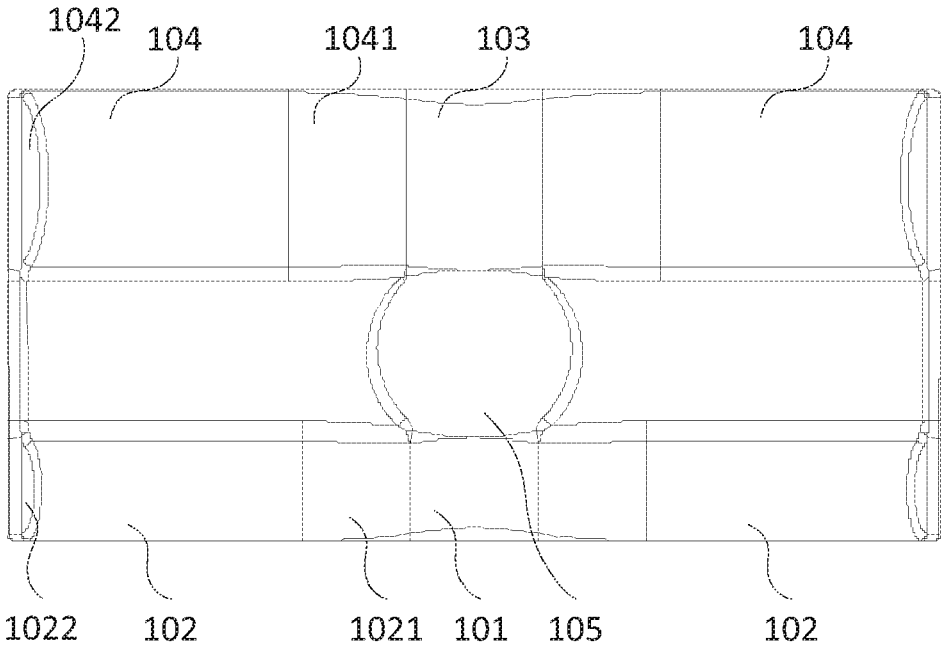
FIG. 2 is a schematic top structural view of an embodiment of a pillow of the present application.
Figure 3:
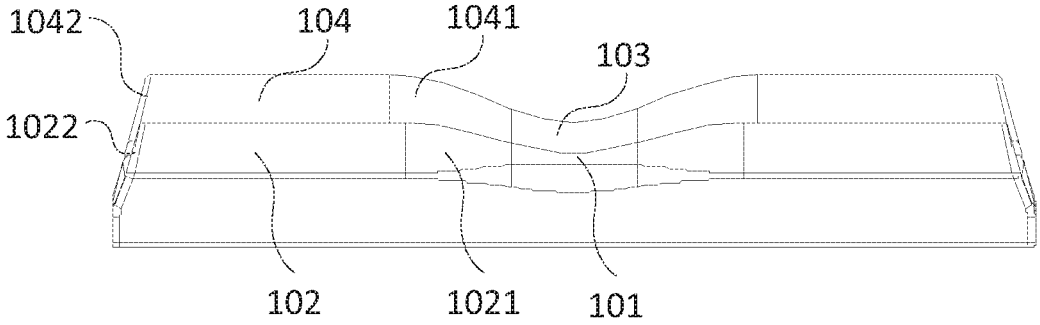
FIG. 3 is a schematic front structural view of an embodiment of a pillow of the present application.
Figure 4:
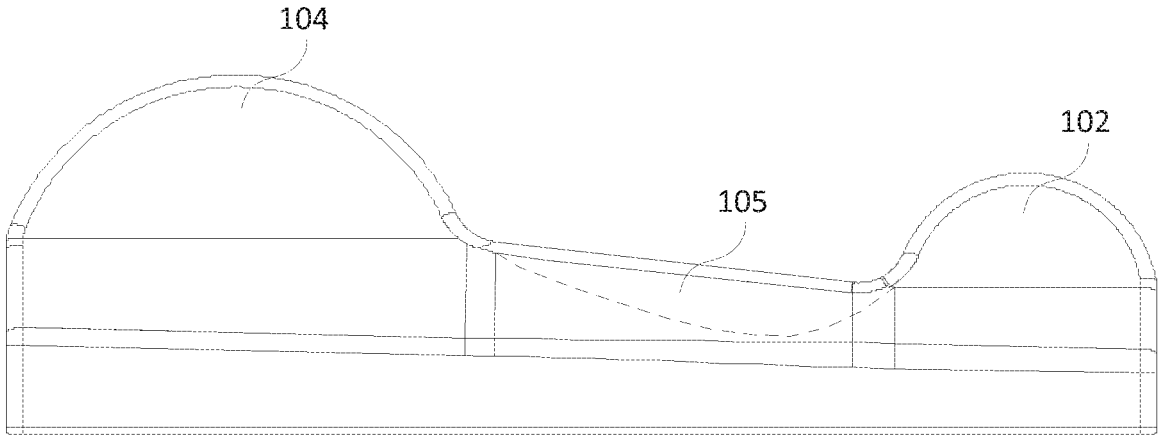
FIG. 4 is a schematic left structural view of an embodiment of t a pillow of the present application.

In the following, the technical solutions in the embodiments of the present application will be clearly and completely described with reference to the drawings in the embodiments of the present application. Obviously, the described embodiments are only a part of the embodiments of the present invention, not all of the implementation example. Based on the embodiments of the present application, all other embodiments obtained by those skilled in the art without creative labor shall fall within the protection scope of the present application.

Referring to FIGS. 1 to 4, an embodiment of the pillow of the present application includes a pillow body 10, a first side of the pillow body 10 is provided with a first raised portion 101 and a second raised portion 102. The first raised portion 101 has a first raised height so as to support a neck of a human body in a supine position. The second raised portion 102 has a second raised height so as to support the neck of the human body in a lateral position. The first height is less than the second height.

Specifically, the first side of the pillow body 10 is provided with two second raised portions 102 and one first raised portion 101, and the two second raised portions 102 are respectively disposed at two ends of the first raised portion 101. An end 1021 of the second raised portion 102 adjacent to the first raised portion 101 is an oblique surface, such that the human body can be slidably moved between the first raised portion 101 and the second raised portion 102. For example, when the human body changes from a supine position to a side position, the human body does not need to raise the neck themselves to be placed on the second raised portion 102, which can be directly moved to the second raised portion 102 from the first raised portion 101 along the oblique surface; and when the human body changes from a side position to a supine position, the neck will not fall directly from the second raised portion 102 to the first raised portion 101, instead, moves gently down from the second raised portion 102 to the first raised portion 101 through the oblique surface, so as to protect the neck of human body. The end 1022 of the second raised portion 102 far from the first raised portion 101 may also be an oblique surface, such that the second raised portion 102 is difficult to deform and has a more stable structure.

In this embodiment, the oblique surface is an arc-shaped oblique surface to reduce the transition angle between the first raised portion 101 and the second raised portion 102, such that the user is more convenient and comfortable when moving between the first raised portion 101 and the second raised portion 102. In other embodiments, the oblique surface may be a linear oblique surface or the like.

The second side of the pillow body 10 is also provided with a third raised portion 103 and a fourth raised portion 104. The height of the second side is greater than the height of the first side, such that the pillow body 10 forms an oblique angle, which is more suitable for the human body when sleeping. The width of the fourth raised portion 104 is greater than the width of the second raised portion 102. The third raised portion 103 has a third raised height so as to support the neck of the human body in a supine position. The fourth raised portion 104 has a fourth raised height so as to support the neck of the human body in a lateral position, and the third height is greater than the first height and less than the fourth height. The second side of the pillow body 10 is provided with two fourth raised portions 104 and one third raised portions 103, and the two fourth raised portions 104 are respectively disposed at both ends of the third raised portion 103.

In this embodiment, the height and width of the third raised portion 103 and the fourth raised portion 104 are respectively greater than the height and width of the first raised portion 101 and the second raised portion 102, which can be supported the head of the human body when the human body lies on the first raised portion 101 or the second raised portion 102. It can also be used to support a neck of a second user (that is, the length and height of the head and neck are different from those of the first user who adapt to the first raised portion 101 and the second raised portion 102) when in a supine position or in a lateral position.

Similar to the second raised portion 102, an end 1041 of the fourth raised portion 104 adjacent to the third raised portion 103 is oblique surface to facilitate a slidable moving between the third raised portion 103 and the fourth raised portion 104. An end 1042 of the fourth raised portion 104 away from the third raised portion 103 may also be an oblique surface to make the structure of the fourth raised portion 104 more stable.

Figure 5:
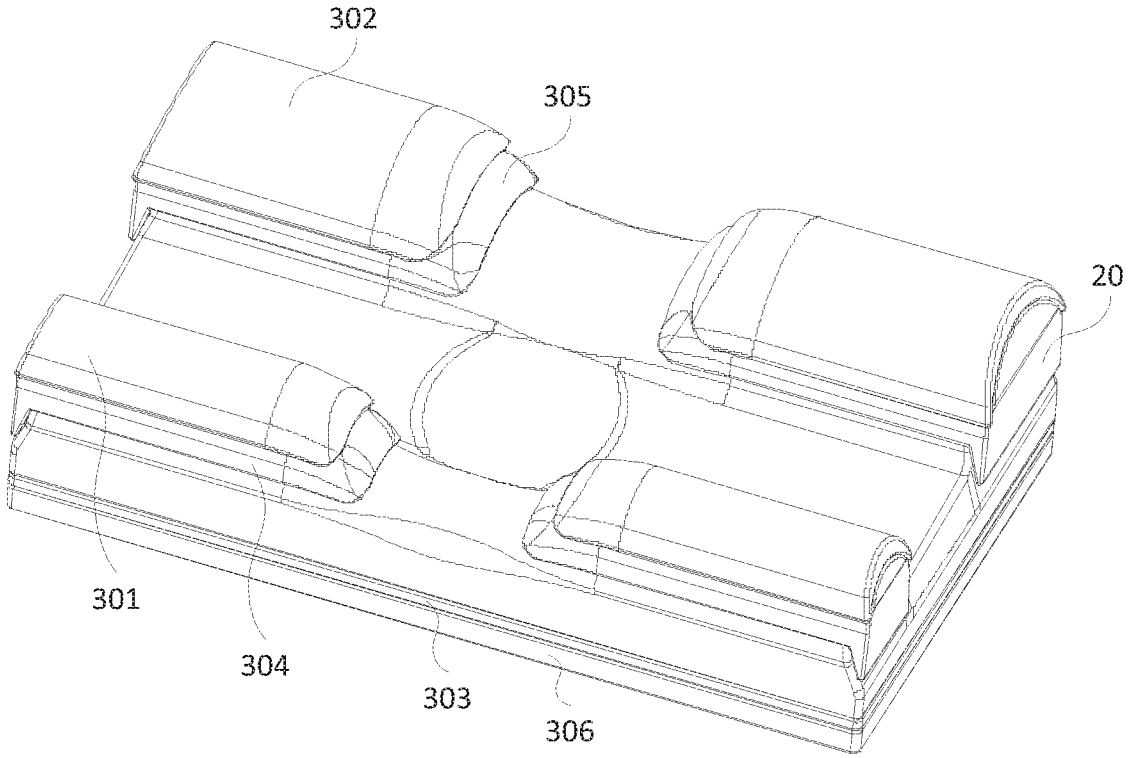
FIG. 5 is a schematic structural view of another embodiment of a pillow of the present application.
Figure 6:
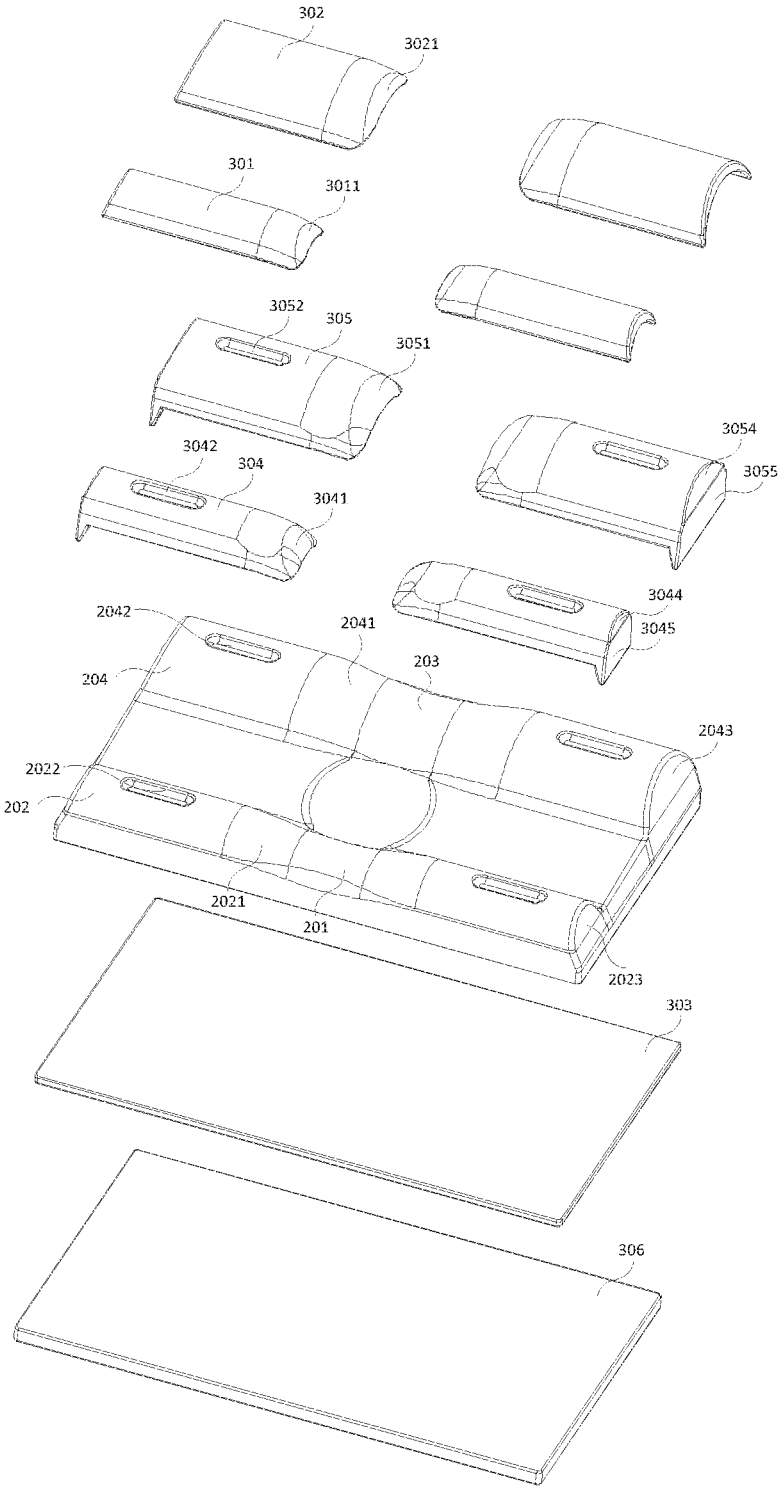
FIG. 6 is a schematic exploded view of another embodiment of a pillow of the present application.
Figure 7:
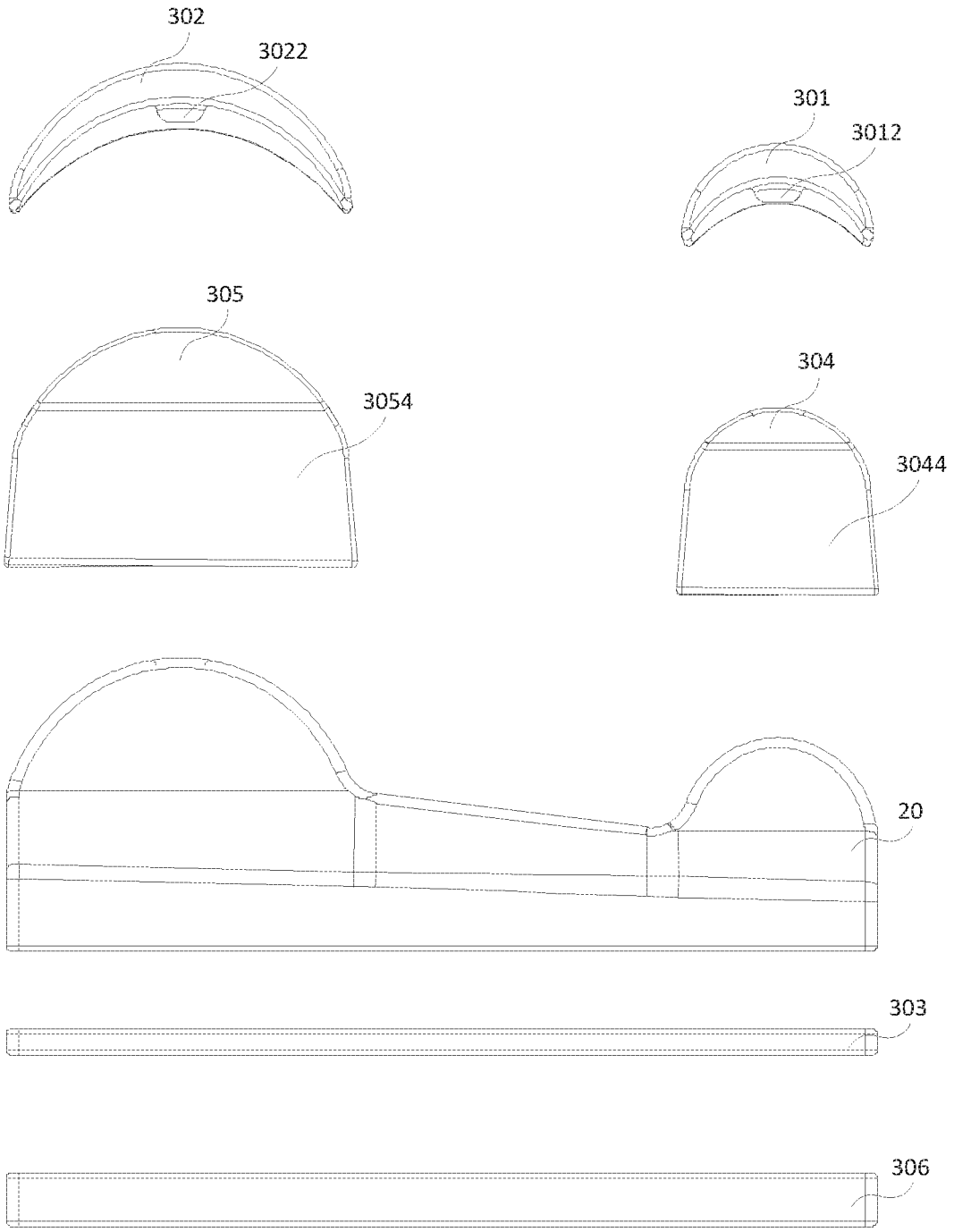
FIG. 7 is a schematic left structural view of another embodiment of a pillow of the present application.
Figure 8:
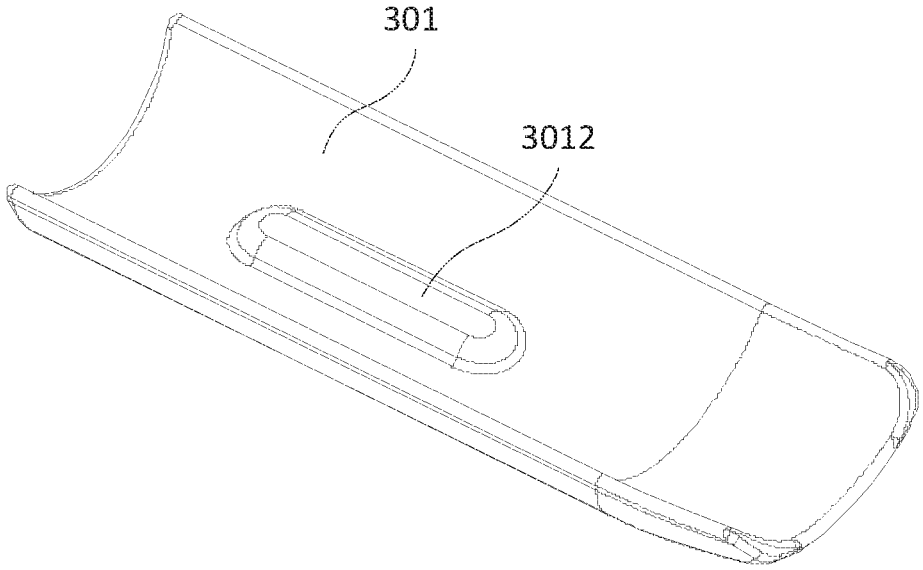
FIG. 8 is a schematic structural view of a heightening pad in another embodiment of a pillow of the present application.
Figure 9:
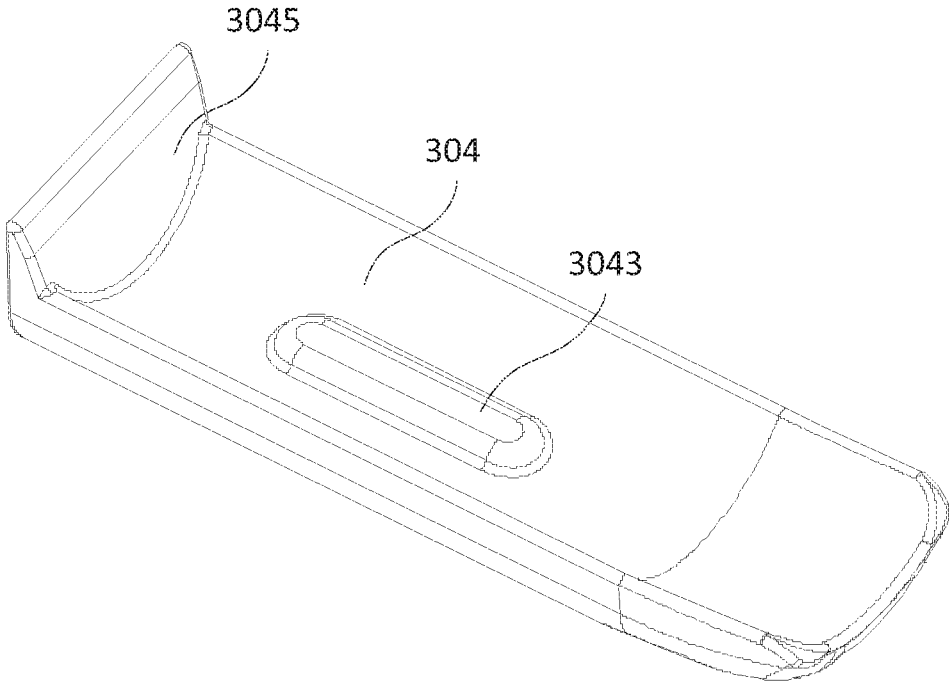
FIG. 9 is a schematic structural view of a clamping pad in another embodiment of a pillow of the present application.

In this embodiment, a recessed portion 105 is further provided on the middle portion of the pillow body 10, which is disposed between the first raised portion 101 and the third raised portion 103 and used for accommodating the head of the human body. Referring to FIG. 5, the cross section of the recessed portion 105 perpendicular to a length direction of the pillow is an eccentric arc to fit the width and height of the first raised portion 101 and the third raised portion 103, respectively. When the user is respectively located at the first raised portion 101 and the third raised portion 103, the head is tilted back slightly to fit the contours of the human head and neck, making the user more comfortable during sleeping.

In other embodiments, a recessed portion may also be provided on the pillow body 10 between the second raised portion 102 and the fourth raised portion 104 to accommodate the head of the human body in a lateral position.

In the present application, the first sides of the pillow body are provided with raised portions with different positions, which can meet the different requirements of heights of the pillow of human body in different sleeping positions, the structure is simple, and is helpful for human head to relax and improve sleep quality.

Referring to FIGS. 5 to 8, another embodiment of the pillow of the present invention includes a pillow body 20. A first side 201 of the pillow body 20 is provided with a first raised portion 201 and a second raised portion 202. The first raised portion 201 has a first raised height so as to support a neck of a human body in a supine position. The second raised portion 202 has a second raised height so as to support the neck of the human body in a lateral position. The first height is less than the second height. The second side of the pillow body 20 is also provided with a third raised portion 203 and a fourth raised portion 204. The height of the second side is greater than the height of the first side. The width of the fourth raised portion 204 is greater than the width of the second raised portion 202. The third raised portion 203 has a third raised height so as to support the neck of the human body in a supine position. The fourth raised portion 204 has a fourth raised height so as to support the neck of the human body in a lateral position, and the third height is greater than the first height and less than the fourth height. An end 2021 of the second raised portion 202 adjacent to the first raised portion 201, and an end 2023 away from the first raised portion 201 are oblique surfaces, and an end of the fourth raised portion 204 adjacent to the third raised portion 203 2041 and an end 2043 away from the third raised portion 203 are oblique surfaces.

The pillow further includes a first heightening pad 301 and a second heightening pad 302. An end 3011 of the first heightening pad 301 adjacent to the first raised portion 201 is oblique surface, and is located on the same side as the end 2021 of the second raised portion 202 adjacent to the first raised portion 201. The oblique surface is convenient for the human body to be slidable moved between the first raised portion 201 and the first heightening pad 301. An end 3012 of the first heightening pad 301 away from the first raised portion 201 is an oblique surface, and is located on the same oblique surface as an end 2023 of the second raised portion 202 away from the first raised portion 201 to enhance the stability of the first heightening pad 301. Similarly, an end 3021 of the second heightening pad 302 adjacent to the third raised portion 203 and an end 3022 away from the third raised portion 203 are also oblique surfaces.

Among them, a first joint portion 3012 is provided on the lower side of the first heightening pad 301, and a second joint portion 2022 corresponding to the first joint portion 3012 is provided on the upper side of the second raised portion 202. The first joint portion 3012 and the second joint portion 2022 are combined to fix the first heightening pad 301 on the second raised portion 202; a third joint portion (not shown) is provided on the lower side of the second heightening pad 302, and a fourth joint portion 2042 corresponding to the third joint portion is provided on the upper side of the fourth raised portion 204. The third joint portion and the fourth joint portion 2042 are combined to fix the second heightened pad 302 on the fourth raised portion 204. The length and width of the first heightening pad 301 are less than or equal to the length and width of the second raised portion 202, respectively; and the length and width of the second heightening pad 302 are less than or equal to the length and width of the fourth raised portion 204, respectively.

In this embodiment, the first joint portion 3012, the third joint portion are oval-shaped protrusions, and the second joint portion 2022, the fourth joint portion 2042 are oval-shaped grooves corresponding to the first joint portion 3012 and the third joint portion, respectively. In other embodiments, the first joint portion 3012 and the third joint portion may also be protrusions of other shapes, such as a circular protrusion, a conical protrusion, a polygonal protrusion, and a protrusion having a trapezoidal section along a length direction of first joint portion 3012 and the like, and the second joint portion 2022 and the fourth joint portion 2042 are grooves corresponding to the shape of the protrusion. In other embodiments, the first joint portion 3012 and the third joint portion are grooves, and the second joint portion 2022 and the fourth joint portion 2042 are protrusions corresponding to the first joint portion 3012 and the third joint portion, respectively. The first joint portion 3012, the second joint portion 2022, the third joint portion, and the fourth joint portion 2042 may also be fixed structures such as an adhesive, a Velcro and the like. The contact surfaces or the entirety of the first heightening pad 301 and the second heightening pad 302 with the first raised portion 201 and the second raised portion 202, respectively, can also be made of a material with high friction such as rubber, that is, there is no need to provide the first joint portion, the second joint portion, the third joint portion, and the fourth joint portion, the first heightening pad 301 and the second heightening pad 302 can be adhered to be fixed by the friction.

The pillow further includes a first base pad 303 that is fixedly disposed on a lower side of the pillow body 20. In this embodiment, the first base pad 303 may be made of rubber, and is directly fixed to the pillow body 20 by friction. In other embodiments, a fifth joint portion (not shown) may be provided on the upper side of the first base pad 303, and a sixth joint portion corresponding to the fifth joint portion may be provided on the lower side of the pillow body 20, the fifth joint portion is combined with the sixth joint portion to fix the first base pad 303 under the pillow. The fifth joint portion and the sixth joint portion may be a concave-convex structure that cooperates with each other, or may be a joint structure such as an adhesive or a Velcro.

In this embodiment, the pillow further includes a first clamping pad 304, a second clamping pad 305, and a second base pad 306. The first clamping pad 304 is disposed between the second raised portion 202 and the first heightening pad 301. The second clamping pad 305 is disposed between the fourth raised portion 204 and the second heightening pad 302, and the second base pad 306 is disposed under the first base pad 303. An end 3041 of the first clamping pad 304 adjacent to the first raised portion 201 is an oblique surface, and is located on the same oblique surface as the end 2021 of the second raised portion 202 adjacent to the first raised portion 201, such that the human body can be slidably moving between the first raised portion 201 and the first heightening pad 301. An end 3044 of the first clamping pad 304 away from the first raised portion 201 is an oblique surface, and is located on the same oblique surface as the end 2023 of the second raised portion 202 away from the first raised portion 201 to enhance the stability of the first clamping pad 304. Similarly, an end 3051 of the second clamping pad 305 adjacent to the third raised portion 203 and an end 3054 away from the third raised portion 203 are also oblique surfaces.

Among them, the lower side of the first clamping pad 304 is provided with a joint portion 3043 similar to the first joint portion 3012 for joining with the second joint portion 2022, and the upper side of the first clamping pad 304 is also provided with a joint portion 3042 similar to the second joint portion 2022 for joining with the first joint portion 3012. Similarly, the upper and lower sides of the second clamping pad 305 are provided with joint portions for jointing with the fourth joint portion 2042 and the third joint portion, respectively. In other embodiments, the first clamping pad 304 and the second clamping pad 305 can also be fixed by other methods such as adhesive, a Velcro, and the like. The thickness of the second base pad 306 is greater than the thickness of the first base pad 303.

The end of the first clamping pad 304 away from the first raised portion 201 is further provided with a first bonding portion 3045, which is formed by the end of the first clamping pad 304 away from the first raised portion 201 extending toward a direction adjacent to the pillow body 20, and configured to be bonded with an end of the second raised portion 202 away from the raised portion 201 to enhance the joint force between the first clamping pad 304 and the second raised portion 202 and to make the overall structure more stable. Similarly, the second clamping pad 305 is also provided with a second bonding portion 3055.

Through the above structural design, it is possible to ensure that a person maintains a normal physiological curve of the cervical spine when in a supine position, and maintains the normal level of the cervical spine when in a lateral position; furthermore, it is possible to keep the soft tissues of the neck relaxed while sleeping. It can create a space for repair of the cervical spine. This is the role of pillows in promoting general health and correcting the spine when used in general.

In addition, the pillow structure of the present application can be spliced and adjusted, thereby breaking the traditional qualitative that the pillow can only be integrated, such that the user can maintain the normal physiological curvature of the cervical spine when in a supine position, and the head and face facing directly forward when in a lateral position. At the same time, maintain the level of the cervical spine and spine, so that people can give the neck soft tissues a chance to rest and create space for cervical repair during sleeping. The above-mentioned functions are implemented by the user in a "self-tailored" manner by using the characteristics of the free combination structure.

In other embodiments, the pillow may further include a plurality of first clamping pads 304, second clamping pads 305, and second base pads 306, wherein the positions of the clamping pads and the heightening pads can also be interchanged, such that the height can be adjusted according to the needs of the user to meet the needs of different groups of people.

In other embodiments, the pillow may further include a monitor, which is arranged in the pillow and used to monitor the human heart rate, breathing, body temperature, snoring, ovulation period, or external environmental conditions, and provide a data basis for human health monitoring. The pillow may also include a player, which is arranged in the pillow and used as an alarm clock to wake up the user by sound, light or vibration, or as a music player. The pillow may further include a medicine bag, which is arranged in the pillow, and the medicine bag may be filled with medicines or incense flowers and herbs, which is used to emit a medicine smell or fragrance, and provides users with a health care or treatment effect.

In the present application, the first side of the pillow body is provided with raised portions with different positions, which can meet the different requirements of heights of the pillow of human body in different sleeping positions, the structure is simple, and is helpful for human head to relax and improve sleep quality. The two sides of the pillow body are provided with raised portions of different heights and/or widths, and heightening pads and base pads are provided, which can adapt to the shape of the head and neck of different people, and conveniently adjust the size of the pillow for different people.

The aforementioned embodiments are only preferred embodiments of the present application. For one of ordinary skill in the art, according to the thought of the present application, specific implementation modes and application scopes may be modified, and the content of the specification should not be interpreted as any limitation to the present application.

What is claimed is:

1. A pillow, comprising:

a pillow body;

a first raised portion, disposed on a first side of the pillow body and having a first raised height so as to support a neck of a human body in a supine position; and a second raised portion, being adjustable in height, disposed on a side of the pillow body and having a second raised height so as to support the neck of the human body in a lateral position;

wherein the first height is less than the second height and wherein an end of the second raised portion adjacent to the first raised portion is an oblique surface, such that the human body can be slidably moved between the first raised portion and the second raised portion, wherein the pillow further comprises a plurality of first heightening pads that are stackable on the second raised portion so as to adjust a height of the second raised portion, and further comprising a lower side of each of the plurality of the first heightening pads is arranged with a first joint portion, an upper side of the second raised portion is provided with a second joint portion corresponding to the first joint portion, and first joint portion is combined with the second joint portion to fix each of the plurality of the first heightening pads on the second raised portion.

2. The pillow of claim 1, wherein the first side of the pillow body is provided with two second raised portions and one first raised portion, and the two second raised portions are respectively disposed at two ends of the first raised portion.

3. The pillow of claim 1, wherein a second side of the pillow body is provided with a third raised portion and a fourth raised portion, a height of the second side is greater than that of the first side, a width of the fourth raised portion is greater than that of the second raised portion, the third raised portion has a third raised height so as to support the neck of the human body in a supine position, the fourth raised portion has a fourth raised height so as to support the neck of the human body in a lateral position, and the third height is greater than the first height and less than the fourth height.

4. The pillow of claim 1, wherein a middle portion of the pillow body is provided with a recessed portion configured for accommodating a head of the human body.

5. The pillow of claim 1, wherein a length and a width of each of the plurality of the first heightening pads are respectively less than a length and a width of the second raised portion.

6. The pillow of claim 5, wherein an end of each of the plurality of the first heightening pads adjacent to the first raised portion is an oblique surface, and is located on a same oblique surface as an end of the second raised portion adjacent to the first raised portion, such that the human body can be slidably moved between the first raised portion and the second raised portion.

7. The pillow of claim 1, wherein the pillow further comprises at least one first clamping pad disposed between the second raised portion and each of the plurality of the first heightening pads, and respectively connected with the second raised portion and the first heightening pad.

8. The pillow of claim 1, further comprising a base pad fixedly disposed at a lower side of the pillow body.

9. The pillow of claim 1, wherein the first joint portion is a protrusion being at least one selected from the group consisting of a circular protrusion, a conical protrusion and a polygonal protrusion; and the second joint portion is a groove being at least one selected from the group consisting of a circular groove, a conical groove and a polygonal groove corresponding to that of the first joint portion.

10. The pillow of claim 4, wherein a cross section of the recessed portion perpendicular to a length direction of the pillow is an eccentric arc.

* * * * *